US006997512B1

(12) United States Patent
Yu

(10) Patent No.: US 6,997,512 B1
(45) Date of Patent: Feb. 14, 2006

(54) 360 DEGREE SWIVEL CUSHION FOR BATHROOM USE

(76) Inventor: Ming-Ming Yu, 1F, No. 229-3, Jing Kou Rd., Taoyuan City (TW)

( * ) Notice: Subject to any disclaimer, the term of this patent is extended or adjusted under 35 U.S.C. 154(b) by 0 days.

(21) Appl. No.: 11/021,817

(22) Filed: Dec. 23, 2004

(51) Int. Cl.
*A47C 3/18* (2006.01)

(52) U.S. Cl. ..... 297/344.26; 297/344.21; 108/94; 248/415; 248/349.1

(58) Field of Classification Search ..... 297/344.21, 297/344.26, 461, 240, 242; 248/349.1, 415; 108/22, 94
See application file for complete search history.

(56) References Cited

U.S. PATENT DOCUMENTS 1,859,352 A * 5/1932 Albee ..... 47/39
2,648,579 A * 8/1953 Slyter et al. ..... 384/615
4,026,067 A * 5/1977 Wengel ..... 47/39
4,117,627 A * 10/1978 Slingerland, Jr. ..... 47/39
4,635,894 A * 1/1987 Sammons ..... 248/558
5,149,043 A * 9/1992 Grundmann ..... 248/349.1
5,479,867 A * 1/1996 Blevins et al. ..... 108/94
6,015,188 A * 1/2000 Yundt et al. ..... 297/344.21
6,854,608 B1 * 2/2005 McNeeley et al. ..... 211/78
6,896,330 B1 * 5/2005 Yu ..... 297/344.21

* cited by examiner

*Primary Examiner*—Peter M. Cuomo
*Assistant Examiner*—Joe Edell
(74) *Attorney, Agent, or Firm*—Pro-Techtor Int'l Services

(57) ABSTRACT

A 360 degree swivel cushion for bathroom encompassing a rotating device having a base plate, a ball bearing plate and a rotating plate disposedly configured between a lower fixed pad and an upper rotating pad. A plurality of stainless steel ball bearings atop the ball bearing plate are used to rotate within a large circular track and a small circular track of the rotating plate. Upon a mobility handicapped person sitting atop the cushion, the body can be rotated by merely swaying the body left and right, which thereby conveniences a family member or a house keeper to assist bathing and cleaning the body of the mobility handicapped person. Waterproof anti-skid pads covering the rotating pad and the fixed pad not only provide for comfortable sitting and prevent slipping; moreover, both upper and lower surfaces are available for use.

2 Claims, 2 Drawing Sheets

360 DEGREE SWIVEL CUSHION FOR BATHROOM USE

BACKGROUND OF THE INVENTION (a) Field of the Invention

The present invention relates to a swivel cushion disposed on a chair for bathroom use. Upon a mobility handicapped person sitting on the cushion, the cushion can rotate along with the body swaying left and right, which thereby facilitates bathing and cleaning the body of the person.

(b) Description of the Prior Art

In general, mobility handicapped aged and weak, women and children or bedridden patients depend on the family or a housekeeper to assist them in bathing or cleaning the body when wishing to carry out such a task. However, all traditional chairs for bathroom use have a fixed structure that is unable to rotate or be moved, and for the family or the house keeper wanting to move the mobility handicapped person, apart from being immensely strenuous and difficult, because the traditional chair is merely covered with a cloth cover, there is an extreme possibility of the person sitting down slipping, moreover, the mobility handicapped person might easily fall down and be injured as a result.

SUMMARY OF THE INVENTION

A primary objective of the present invention is to provide a swivel cushion for bathroom use comprising a rotating device having a base plate, a ball bearing plate and a rotating plate disposedly configured between an upper rotating pad and a lower fixed pad. A mobility handicapped person sits on the chair cushion, whereby rotating of the body is realized along by swaying the body left and right, which is convenient for deftly and non-strenuously assisting the mobility handicapped person when bathing and cleaning the body.

Another objective of the present invention is to provide waterproof antiskid pads that respectively cover the upper rotating pad and the lower fixed pad, which not only prevent the cushion slipping on the chair or sliding off the chair after sitting down thereon, moreover, both upper and lower surfaces are available for the user to use.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
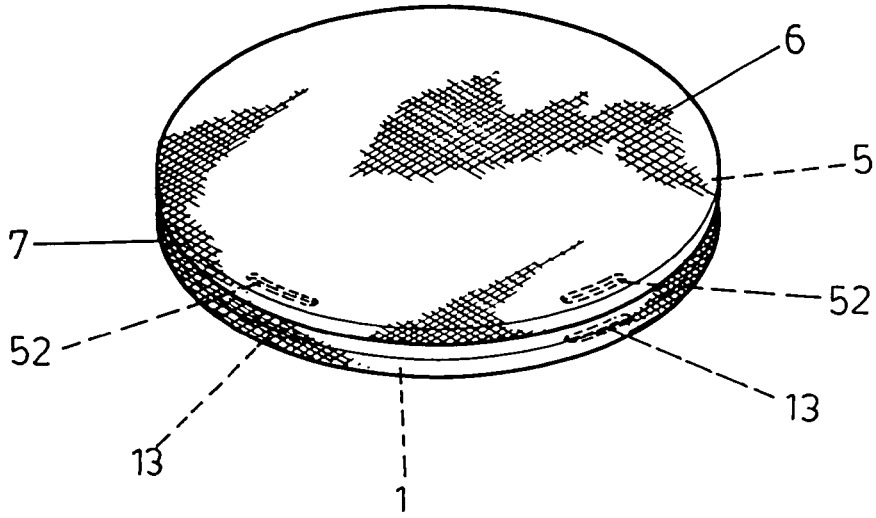
FIG. 1 shows an outward appearance according to the present invention.
Figure 3:
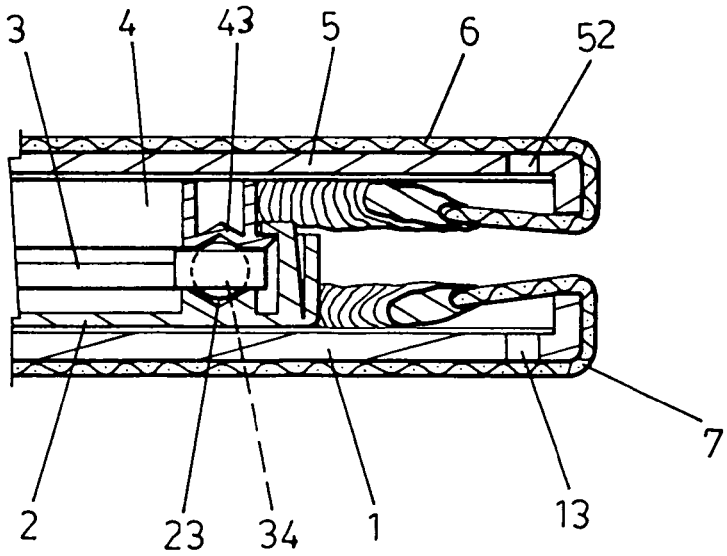
FIG. 3 shows a partial cross-sectional view according to the present invention.
Figure 2:
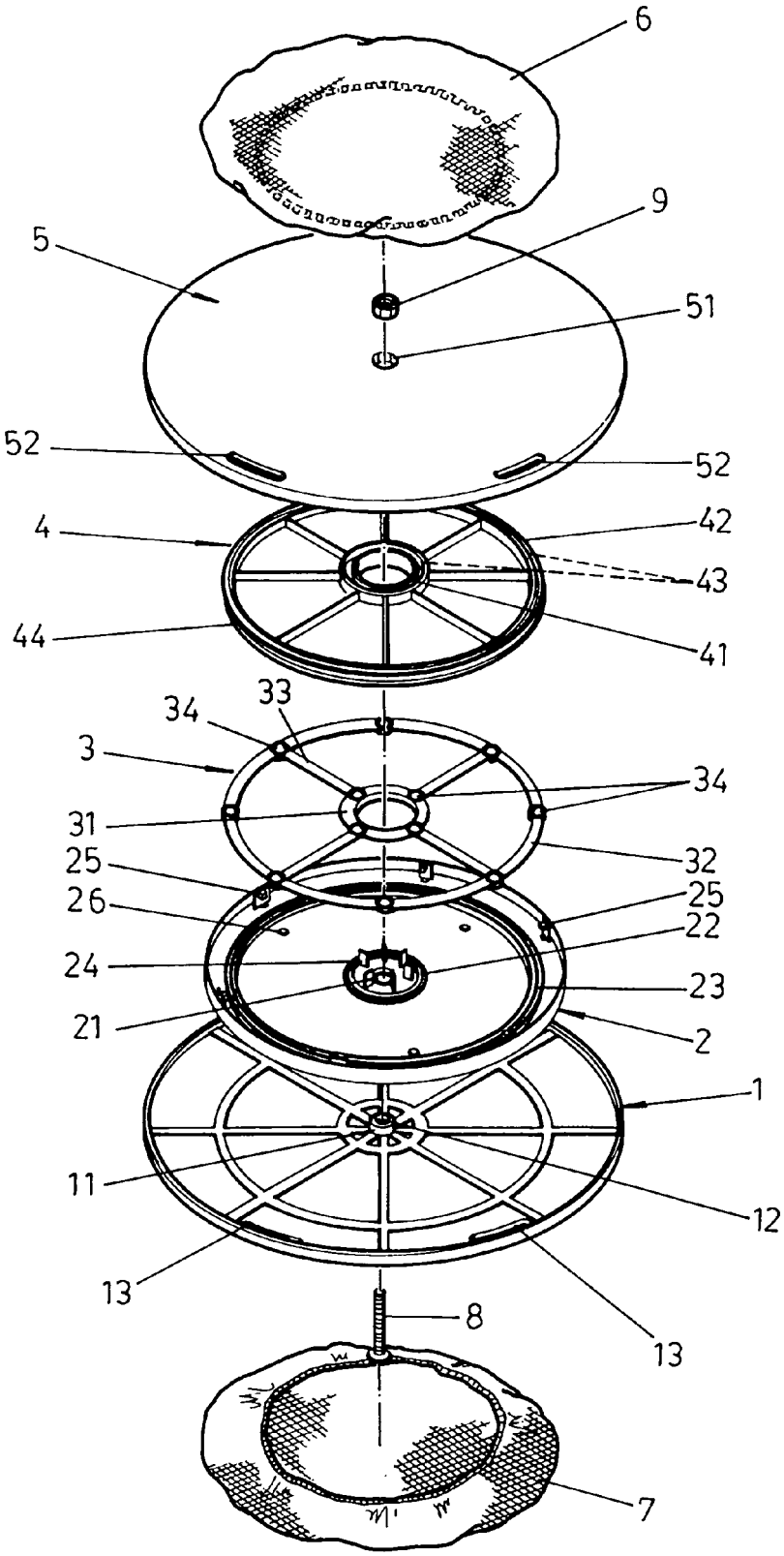
FIG. 2 shows an exploded view according to the present invention.

Referring to FIGS. 1, 2 and 3, the present invention is structured to comprise component members including a fixed pad 1, a base plate 2, a ball bearing plate 3, a rotating plate 4, a rotating pad 5 and antiskid pad covers 6, 7. Wherein center of the circular fixed pad 1 is provided with a circular protruding piece 11, and a through hole 12 is defined center of the protruding piece 11. An edging of the fixed pad 1 is provided with a plurality of strip water outlets

13. A central hole 21 of the circular base plate 2 is fixedly mounted on the protruding piece 11 of the fixed pad 1, and is thereby fixedly positioned thereon. Peripheral of the central hole 21 is provided with a circular track 22 of relatively small diameter, and another circular track 23 of relatively large diameter is configured on an outer perimeter of the circular track 22. A plurality of spacing struts 24 are configured so as to be upright at an inner edge of the small circular track 22. A plurality of inverse L-shaped check pieces 25 are configured at an outer edging of the large circular track 23 so as to encircle a plate edging of the base plate 2. A plurality of water outlets 26 are defined in the base plate 2. The stainless steel ball bearing plate 3 is formed into a turnplate by connecting an inner circular ring 31 to an outer circular ring 32 by means of radius rods 33. Stainless steel ball bearings 34 are respectively disposedly inset in a plurality of ball bearing cavities of the inner circular ring 31 and the outer circular ring 32. The stainless steel ball bearings 34 can thereby respectively sit within the large circular track 23 and the small circular track 22, and, moreover, can roll within the tracks 22 and 23. An inner circular ring 41 and an outer circular ring 42 having external form similar to that of the ball bearing plate 3 is configured on the rotating plate 4. A bottom portion of the inner circular ring 41 and the outer circular ring 42 is respectively provided with an annular track 43, and which are respectively disposedly mounted on the ball bearings 34 (see FIG. 3). An outer edging of the rotating plate 4 is provided with an annular checking flange 44, which can fixedly check within the check pieces 25 of the base plate 2, and thereby prevents the rotating disc 4 from coming loose. The upper rotating pad 5 is disposed atop the rotating plate 4. A through hole 51 is defined center of the rotating pad 5, and a plurality of strip water outlets 52 are defined in two sides of the rotating pad 5. A screw 8 is utilized to pass through the central through hole 12 of the fixed pad 1 and the through hole 51 of the rotating pad 5 from a bottom end of the fixed pad 1, and a screw nut 9 fixedly screws down onto the screw 8 at a top end of the rotating pad 5. The waterproof antiskid pads 6 and 7 are slipped onto the rotating pad 5 and the fixed pad 1 respectively. The upper antiskid pad 6 and the lower antiskid pad 7, apart from preventing the mobility handicapped person from sliding on the cushion when sitting thereon, moreover, can prevent the cushion from slipping on the chair.

The cushion of the present invention is disposed on the chair for bathroom use, and upon a person sitting on the cushion and swaying their body left and right, because of rotating of the rotating plate 4 and the ball bearing plate 3 along with the swaying body, thus, the rotating pad 5 also rotates, which thereby facilitates easy rotating and moving of the mobility handicapped person, and conveniences bathing and cleaning the body of the mobility handicapped person.

In conclusion, the swivel cushion of the present invention provides for the mobility handicapped person to sit thereon, and facilitate easy rotating of the person when the body is swayed left and right, which thereby assists the family member or a house keeper to deftly and non-strenuously assist the mobility handicapped person to bathe and clean their body.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A 360 degree swivel cushion for bathroom use comprising:

a fixed pad, center of which is provided with a protruding piece and a through hole;

a base plate, center of which is defined a central hole, the central hole can fixedly mount on the protruding piece of the fixed pad and thereby fix position thereon, a large circular track and a small circular track are configured on the base plate, a plurality of upright spacing struts are configured at an inner edge of the small circular track, and a plurality of inverse L-shaped check pieces are configured on an outer edging of the base plate;

a ball bearing plate, which is formed from connecting an inner circular ring to an outer circular ring by radially extending rods, stainless steel ball bearings are respectively disposedly inset in a plurality of ball bearing cavities of the inner circular ring and the outer circular ring, and the stainless steel ball bearings respectively sit within the circular tracks of the base plate, and, moreover, can roll therewithin;

a rotating plate, atop of which is configured an inner circular ring and an outer circular ring, a bottom portion of the inner circular ring and the outer circular ring is respectively provided with an annular track, and the annular tracks are respectively disposedly mounted on the ball bearings, an outer edging of the rotating plate is provided with an annular checking flange, which can fixedly check within the check pieces of the base plate;

a rotating pad, which is disposed atop the rotating plate, and a through hole is defined center thereof; and two antiskid pad covers, which respectively cover the rotating pad and the fixed pad;

whereby the swivel cushion assembled with the aforementioned component members may be disposed atop a chair for bathroom use, and thereby deftly and non-strenuously facilitates assisting mobility handicapped person to sway the body left and right in order to bathe.

2. The 360 degree swivel cushion for bathroom use according to claim 1, wherein water outlets are respectively defined in the fixed pad and the rotating pad.

* * * * *